US010152912B2

(12) United States Patent
Hwang

(10) Patent No.: US 10,152,912 B2
(45) Date of Patent: Dec. 11, 2018

(54) DISPLAY APPARATUS AND A METHOD OF OPERATING THE SAME

(71) Applicant: SAMSUNG DISPLAY CO., LTD., Yongin-si, Gyeonggi-do (KR)

(72) Inventor: Jun-Ho Hwang, Asan-si (KR)

(73) Assignee: SAMSUNG DISPLAY CO., LTD., Yongi-si, Gyeonggi-Do (KR)

( * ) Notice: Subject to any disclaimer, the term of this patent is extended or adjusted under 35 U.S.C. 154(b) by 0 days.

(21) Appl. No.: 15/358,829

(22) Filed: Nov. 22, 2016

(65) Prior Publication Data

US 2017/0186389 A1 Jun. 29, 2017

(30) Foreign Application Priority Data

Dec. 29, 2015 (KR) ..... 10-2015-0188716

(51) Int. Cl.
*G09G 3/20* (2006.01)

(52) U.S. Cl.
CPC ..... *G09G 3/2092* (2013.01); *G09G 2310/027* (2013.01); *G09G 2310/0221* (2013.01); *G09G 2310/0275* (2013.01)

(58) Field of Classification Search
CPC .. G09G 3/2092; G09G 3/3648; G09G 3/3406; G09G 3/3696; G09G 3/3614; G09G 5/18
See application file for complete search history.

(56) References Cited

U.S. PATENT DOCUMENTS

| | | | | |
|---|---|---|---|---|
| 8,954,830 | B2 | 2/2015 | Murakami et al. | |
| 2005/0024547 | A1* | 2/2005 | Park | G02F 1/136213 349/39 |
| 2007/0296683 | A1* | 12/2007 | Orisaka | G02F 1/1345 345/100 |
| 2011/0069088 | A1* | 3/2011 | Weng | G09G 3/3688 345/690 |
| 2013/0120349 | A1* | 5/2013 | Oh | G09G 3/3685 345/212 |
| 2015/0221276 | A1* | 8/2015 | Ishii | G09G 3/3696 345/690 |

FOREIGN PATENT DOCUMENTS

| | | |
|---|---|---|
| KR | 1020100108076 | 10/2010 |
| KR | 1020150029981 | 3/2015 |
| KR | 1020150057855 | 5/2015 |

* cited by examiner

*Primary Examiner* — Kevin M Nguyen
(74) *Attorney, Agent, or Firm* — F. Chau & Associates, LLC

(57) ABSTRACT

A display apparatus includes a display panel, a first data driver, a second data driver, and a first capacitor. The display panel is connected to a plurality of data lines. The first data driver is connected to first data lines among the plurality of data lines, and is configured to perform a first charge sharing for the first data lines. The second data driver is connected to second data lines among the plurality of data lines, and is configured to perform a second charge sharing for the second data lines. The first capacitor is connected to the first data driver and the second data driver. Each of the first and second charge sharings is performed using the first capacitor.

19 Claims, 11 Drawing Sheets

DISPLAY APPARATUS AND A METHOD OF OPERATING THE SAME

CROSS-REFERENCE TO RELATED APPLICATION

This application claims priority under 35 U.S.C. § 119 to Korean Patent Application No. 10-2015-0188716, filed on Dec. 29, 2015 in the Korean Intellectual Property Office (KIPO), the disclosure of which is incorporated by reference herein in its entirety.

TECHNICAL FIELD

Exemplary embodiments of the inventive concept relate to displaying images, and more particularly, to display apparatuses and methods of operating the display apparatuses.

DISCUSSION OF RELATED ART

A liquid crystal display (LCD) apparatus is a type of flat panel display (FPD), which has been widely used in recent years. Other examples of FPDs may include, but are not limited to, plasma display panels (PDP) and organic light emitting displays (OLED).

A display apparatus (e.g., an LCD) includes a display panel and a data driver. The data driver applies a plurality of data voltages, corresponding to image data, to a plurality of pixels in the display panel through a plurality of data lines. To minimize voltage variations in the data lines, research is being conducted on techniques of charge sharing between the data lines.

SUMMARY

According to an exemplary embodiment of the inventive concept, a display apparatus includes a display panel, a first data driver, a second data driver, and a first capacitor. The display panel is connected to a plurality of data lines. The first data driver is connected to first data lines among the plurality of data lines, and is configured to perform a first charge sharing for the first data lines. The second data driver is connected to second data lines among the plurality of data lines, and is configured to perform a second charge sharing for the second data lines. The first capacitor is connected to the first data driver and the second data driver. Each of the first and second charge sharings is performed using the first capacitor.

The display apparatus may further include a timing controller. The timing controller may be configured to generate first output image data corresponding to the first data lines and second output image data corresponding to the second data lines in response to input image data, generate a first load signal and a second load signal in response to an input control signal, provide the first output image data and the first load signal to the first data driver, and provide the second output image data and the second load signal to the second data driver.

The first data driver may perform the first charge sharing during a first activation duration of the first load signal. The second data driver may perform the second charge sharing during a second activation duration of the second load signal. The first activation duration of the first load signal or the second activation duration of the second load signal may be variable.

The first activation duration may be substantially the same as the second activation duration.

The first activation duration may be different from the second activation duration.

The timing controller may include a first sensor, a second sensor, a comparator, and a control signal generator. The first sensor may be configured to detect a first sum of first grayscales corresponding to a first portion of the first data lines in response to the first output image data. The second sensor may be configured to detect a second sum of second grayscales corresponding to a second portion of the first data lines in response to the first output image data. The comparator may be configured to generate a first load control signal by comparing the first sum with the second sum. The control signal generator may be configured to generate the first load signal in response to the input control signal and the first load control signal. A first activation duration of the first load signal may be controlled in response to the first load control signal, and the first data driver may perform the first charge sharing during the first activation duration of the first load signal.

When the first sum is substantially the same as the second sum, the first activation duration has a first length. When the first sum is different from the second sum, the first activation duration may have a length that is shorter than the first length.

When a difference between the first sum and the second sum is smaller than a reference value, the first activation duration may have a second length that is shorter than the first length. When the difference between the first sum and the second sum is greater than or equal to the reference value, the first activation duration may have a third length shorter than the second length.

The first portion of the first data lines may include odd-numbered data lines of the first data lines. The second portion of the first data lines may include even-numbered data lines of the first data lines.

The first sensor may be further configured to detect a third sum of third grayscales corresponding to a third portion of the second data lines in response to the second output image data. The second sensor may be further configured to detect a fourth sum of fourth grayscales corresponding to a fourth portion of the second data lines in response to the second output image data. The comparator may be further configured to generate a second load control signal by comparing the third sum with the fourth sum. The control signal generator may be further configured to generate the second load signal in response to the input control signal and the second load control signal. A second activation duration of the second load signal may be controlled in response to the second load control signal, and the second data driver may perform the second charge sharing during the second activation duration of the second load signal.

The timing controller may further include an image processor. The image processor may be configured to generate the first output image data and the second output image data in response to the input image data.

The first data driver may include a first switch and a second switch. The first switch may include a first terminal connected to a first electrode of the first capacitor and a second terminal connected to odd-numbered data lines of the first data lines. The second switch may include a first terminal connected to a second electrode of the first capacitor and a second terminal connected to even-numbered data lines of the first data lines.

The display apparatus may further include a third data driver. The third data driver may be connected to the first capacitor and third data lines among the plurality of data lines, and may be configured to perform a third charge sharing for the third data lines. The first, second, and third data drivers may share the first capacitor, and the third charge sharing may be performed using the first capacitor.

The display apparatus may further include a third data driver, a fourth data driver, and a second capacitor. The third data driver may be connected to third data lines among the plurality of data lines, and may be configured to perform a third charge sharing for the third data lines. The fourth data driver may be connected to fourth data lines among the plurality of data lines, and may be configured to perform a fourth charge sharing for the fourth data lines. The second capacitor may be connected to the third data driver and the fourth data driver. Each of the third and fourth charge sharings may be performed using the second capacitor.

According to an exemplary embodiment of the inventive concept, in a method of operating a display apparatus, the display apparatus includes a first data driver and a second data driver. A first load signal is generated in response to input image data and an input control signal. With the first data driver, a first charge sharing for first data lines, among a plurality of data lines, is performed using a first capacitor and the first load signal. A second load signal is generated in response to the input image data and the input control signal. With the second data driver, a second charge sharing for second data lines, among the plurality of data lines, is performed using the first capacitor and the second load signal. The first and second data drivers share the first capacitor.

In generating the first load signal, a first sum of first grayscales corresponding to a first portion of the first data lines may be detected in response to the input image data. A second sum of second grayscales corresponding to a second portion of the first data lines may be detected in response to the input image data. A first load control signal may be generated by comparing the first sum with the second sum. The first load signal may be generated in response to the input control signal and the first load control signal. A first activation duration of the first load signal may be controlled in response to the first load control signal, and the first data driver may perform the first charge sharing during the first activation duration of the first load signal.

When the first sum is substantially the same as the second sum, the first activation duration may have a first width. When the first sum is different from the second sum, the first activation duration may have a width that is shorter than the first width.

When a difference between the first sum and the second sum is smaller than a reference value, width of the first activation duration may have a second width that is shorter than the first width. When the difference between the first sum and the second sum is greater than or equal to the reference value, the first activation duration may have a third width that is shorter than the second width.

The first portion of the first data lines may include odd-numbered data lines of the first data lines. The second portion of the first data lines may include even-numbered data lines of the first data lines.

In generating the second load signal, a third sum of third grayscales corresponding to a third portion of the second data lines may be detected in response to the input image data. A fourth sum of fourth grayscales corresponding to a fourth portion of the second data lines may be detected in response to the input image data. A second load control signal may be generated by comparing the third sum with the fourth sum. The second load signal may be generated in response to the input control signal and the second load control signal. A second activation duration of the second load signal may be controlled in response to the second load control signal, and the second data driver may perform the second charge sharing during the second activation duration of the second load signal.

According to an exemplary embodiment of the inventive concept, a display apparatus includes a display panel, a timing controller, a first data driver, a second data driver, and a first capacitor. The display panel is connected to a plurality of data lines. The timing controller is configured to generate a first load signal and a second load signal. The first data driver includes a first switch and a second switch, and is connected to first data lines among the plurality of data lines. The second data driver includes a third switch and a fourth switch, and is connected to second data lines among the plurality of data lines. The first capacitor is connected to the first data driver and the second data driver. The first switch connects a first portion of the first data lines to a first electrode of the first capacitor in response to the first load signal. The second switch connects a second portion of the first data lines to a second electrode of the first capacitor in response to the first load signal. The third switch connects a third portion of the second data lines to the first electrode of the first capacitor in response to the second load signal. The fourth switch connects a fourth portion of the second data lines to the second electrode of the first capacitor in response to the second load signal.

BRIEF DESCRIPTION OF THE DRAWINGS

The above and other features of the inventive concept will be more clearly understood by describing in detail exemplary embodiments thereof with reference to the accompanying drawings.

DETAILED DESCRIPTION OF THE EMBODIMENTS

Figure 1:
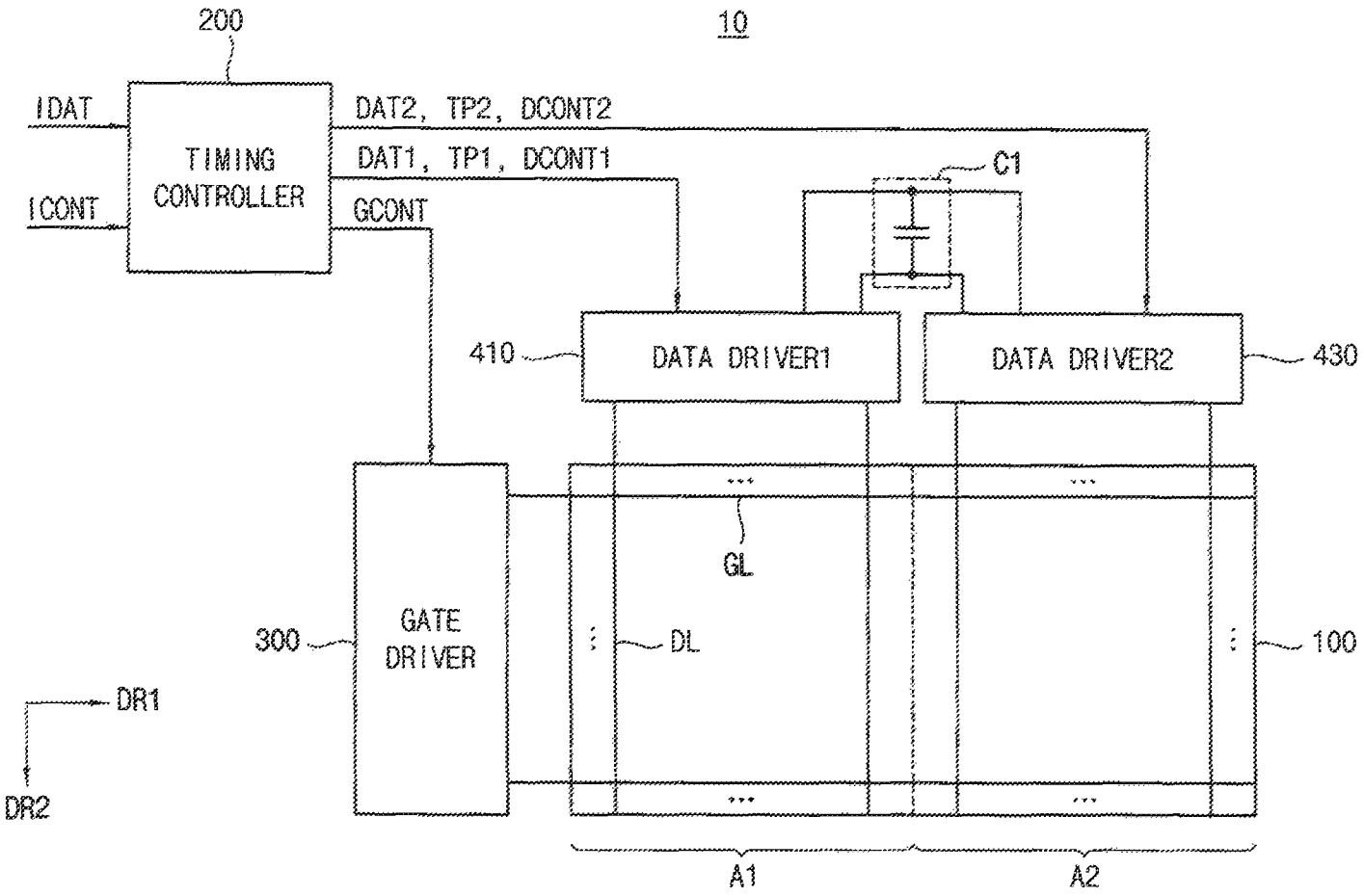
FIG. 1 is a block diagram illustrating a display apparatus according to an exemplary embodiment of the inventive concept.

Exemplary embodiments of the inventive concept will be described more fully hereinafter with reference to the accompanying drawings. Like reference numerals refer to like elements throughout the accompanying drawings.

Exemplary embodiments of the inventive concept provide a display apparatus configured with charge sharing, which is capable of preventing deterioration of display quality, and a method of operating the display apparatus.

FIG. 1 is a block diagram illustrating a display apparatus according to an exemplary embodiment of the inventive concept.

Referring to FIG. 1, a display apparatus 10 includes a display panel 100, a timing controller 200, a gate driver 300, a first data driver 410, a second data driver 430, and a first capacitor C1.

The display panel 100 operates (e.g., displays an image) based on first output image data DAT1 and second output image data DAT2. The display panel 100 is connected to a plurality of gate lines GL and a plurality of data lines DL. The gate lines GL may extend in a first direction DR1, and the data lines DL may extend in a second direction DR2 crossing (e.g., substantially perpendicular to) the first direction DR1. The display panel 100 may include a plurality of pixels that are arranged in a matrix form. Each pixel may be electrically connected to one of the gate lines GL and one of the data lines DL.

According to exemplary embodiments of the inventive concept, the display panel 100 may be divided into a plurality of display regions. For example, the display panel 100 may include a first region A1 and a second region A2. The first and second regions A1 and A2 in the display panel 100 may operate based on control of the first and second data drivers 410 and 430, respectively. The number and arrangement of regions in the display panel 100 can be changed.

The timing controller 200 controls operations of the display panel 100, the gate driver 300, the first data driver 410, and the second data driver 430. The timing controller 200 receives input image data IDAT and an input control signal ICONT from an external device (e.g., a host or a graphics processor). The input image data IDAT may include a plurality of pixel data for the plurality of pixels. The input control signal ICONT may include a master clock signal, a data enable signal, a vertical synchronization signal, a horizontal synchronization signal, etc.

The timing controller 200 generates the first and second output image data DAT1 and DAT2 based on the input image data IDAT. The first output image data DAT1 may correspond to the first region A1 and first data lines among the plurality of data lines DL, and the second output image data DAT2 may correspond to the second region A2 and second data lines among the plurality of data lines DL. For example, the first data lines may be arranged in the first region A1, and the second data lines may be arranged in the second region A2. The timing controller 200 generates a first control signal GCONT in response to the input control signal ICONT. The first control signal GCONT may be provided to the gate driver 300, and a driving timing of the gate driver 300 may be controlled in response to the first control signal GCONT. The first control signal GCONT may include a vertical start signal, a gate clock signal, etc. The timing controller 200 generates a first load signal TP1, a second load signal TP2, a second control signal DCONT1, and a third control signal DCONT2 in response to the input control signal ICONT. The first load signal TP1 and the second control signal DCONT1 may be provided to the first data driver 410, and the second load signal TP2 and the third control signal DCONT2 may be provided to the second data driver 430. Driving timings of the first and second data drivers 410 and 430 may be controlled in response to the first and second load signals TP1 and TP2, respectively, and the second and third control signals DCONT1 and DCONT2, respectively. The second and third control signals DCONT1 and DCONT2 may include a horizontal start signal, a data clock signal, a polarity control signal, etc.

The gate driver 300 generates a plurality of gate signals for driving the gate lines GL in response to the first control signal GCONT. The gate driver 300 may sequentially provide the gate signals to the gate lines GL. For example, the gate driver 300 may include a plurality of shift registers.

The first data driver 410 is connected to the first data lines. The first data driver 410 generates a plurality of first data voltages (e.g., analog voltages) in response to the first load signal TP1, the second control signal DCONT1, and the first output image data DAT1 (e.g., digital data). The first data driver 410 may sequentially provide the first data voltages to the first data lines.

The second data driver 430 is connected to the second data lines. The second data driver 430 generates a plurality of second data voltages in response to the second load signal TP2, the third control signal DCONT2 and the second output image data DAT2. The second data driver 430 may sequentially provide the second data voltages to the second data lines.

According to exemplary embodiments of the inventive concept, the gate driver 300 and/or the data drivers 410 and 430 may be disposed, e.g., directly mounted, on the display panel 100, or may be connected to the display panel 100 as a tape carrier package (TCP) type. Alternatively, the gate driver 300 and/or the data drivers 410 and 430 may be integrated into the display panel 100.

The first capacitor C1 is connected to the first data driver 410 and the second data driver 430. For example, as will be described later with reference to FIG. 2, the first data driver 410 and the first capacitor C1 may be connected in parallel with each other, and the second data driver 430 and the first capacitor C1 may be connected in parallel with each other.

According to exemplary embodiments of the inventive concept, the first capacitor C1 may be attached on a printed circuit board (PCB) on which the timing controller 200 is mounted. Alternatively, the first capacitor C1 may be attached on a flexible PCB (FPCB) on which the data drivers 410 and 430 are mounted.

In the display apparatus 10 according to an exemplary embodiment of the inventive concept, the first data driver 410 performs a first charge sharing for the first data lines, and the second data driver 430 performs a second charge sharing for the second data lines. In a display apparatus, charge sharing may be an operation where a plurality of data lines are electrically connected to one another for a predetermined duration before a plurality of data voltages are applied to the plurality of data lines. By performing the charge sharing, voltage variations in the plurality of data lines may be minimized, and power consumption and temperature may be reduced in the display apparatus.

According to an exemplary embodiment of the inventive concept, the first and second data drivers 410 and 430 included in the display apparatus 10 may share the first capacitor C1 to perform the charge sharing. Each of the first and second charge sharings may be performed using the first capacitor C1. The first and second data voltages may be applied to the first and second data lines, respectively, after the first and second charge sharings are completed.

Figure 2:
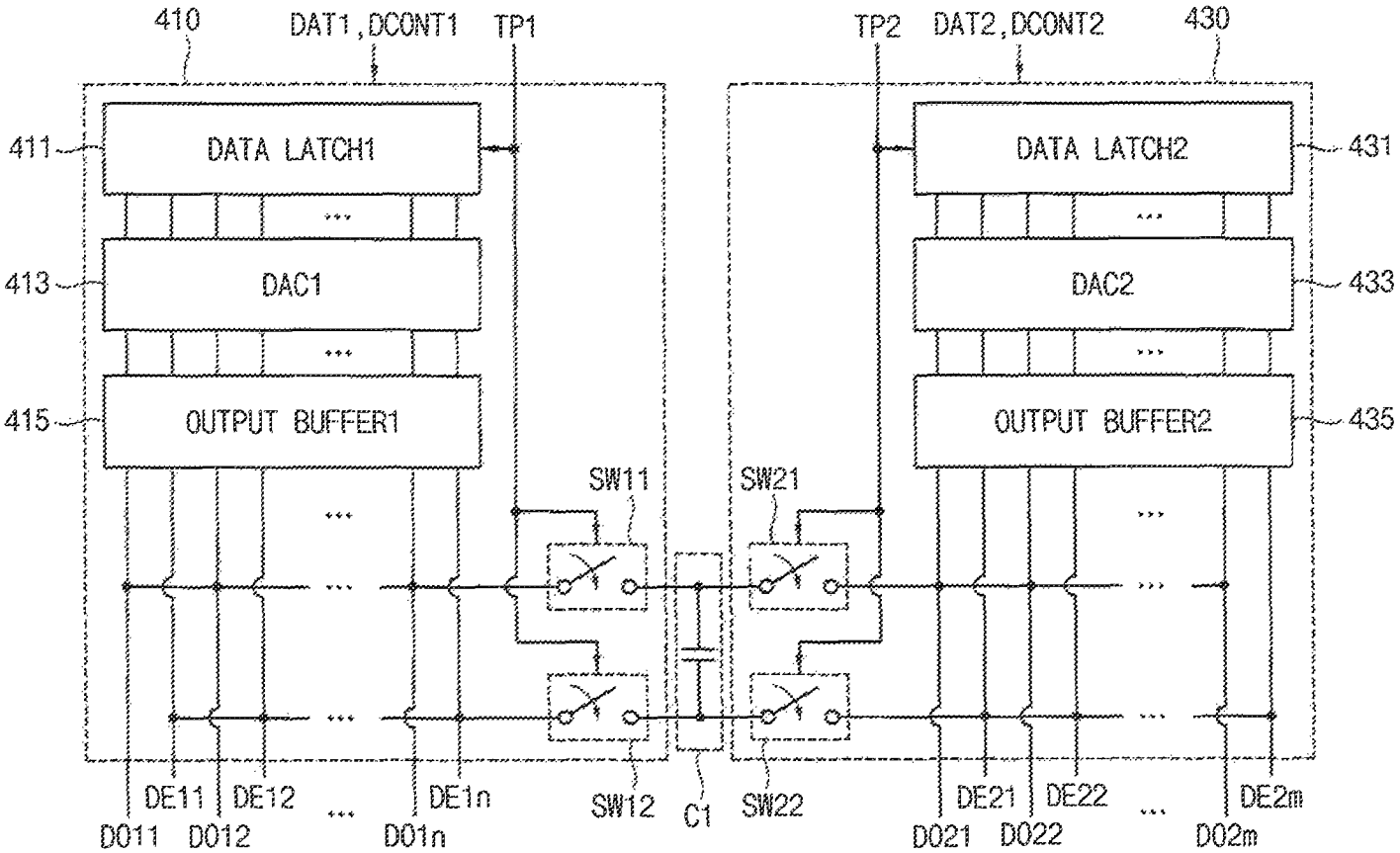
FIG. 2 is a diagram illustrating data drivers and a capacitor included in the display apparatus according to an exemplary embodiment of the inventive concept.

FIG. 2 is a diagram illustrating data drivers and a capacitor included in the display apparatus according to an exemplary embodiment of the inventive concept.

Referring to FIGS. 1 and 2, the first capacitor C1 may be connected to the first and second data drivers 410 and 430.

The first data driver 410 may include a first data latch 411, a first digital-to-analog converter 413, a first output buffer 415, a first switch SW11, and a second switch SW12.

The first data latch 411 may sequentially store the first output image data DAT1 (e.g., serial data) in response to a first latch control signal included in the second control signal DCONT1, and may substantially simultaneously output the first output image data DAT1 (e.g., parallel data) in response to the first load signal TP1. The first digital-to-analog converter 413 may generate the first data voltages based on the first output image data DAT1 and a first polarity control signal included in the second control signal DCONT1. For example, the first digital-to-analog converter 413 may convert the first output image data DAT1 into the first data voltages. The first output buffer 415 may output the first data voltages to the first data lines (e.g., data lines DO11, DE11, DO12, DE12, . . . , DO1*n*, and DE1*n*).

The first switch SW11 may include a first terminal connected to a first electrode of the first capacitor C1 and a second terminal connected to a first portion of the first data lines DO11~DE1*n*. For example, the first portion of the first data lines DO11~DE1*n* may include odd-numbered data lines DO11, DO12, . . . , and DO1*n* of the first data lines DO11~DE1*n*. The second switch SW12 may include a first terminal connected to a second electrode of the first capacitor C1 and a second terminal connected to a second portion of the first data lines DO11~DE1*n*. For example, the second portion of the first data lines DO11~DE1*n* may include even-numbered data lines DE11, DE12, . . . , and DE1*n* of the first data lines DO11~DE1*n*.

The first and second switches SW11 and SW12 may selectively connect the first capacitor C1 with the first data lines DO11~DE1*n* in response to the first load signal TP1. For example, when the first load signal TP1 is activated, the first capacitor C1 may be electrically connected to the first data lines DO11~DE1*n*, and the first data driver 410 may perform the first charge sharing during an activation duration of the first load signal TP1.

The structure of the second data driver 430 may be substantially the same as that of the first data driver 410. The second data driver 430 may include a second data latch 431, a second digital-to-analog converter 433, a second output buffer 435, a third switch SW21, and a fourth switch SW22.

The second data latch 431 may sequentially store the second output image data DAT2 in response to a second latch control signal included in the third control signal DCONT2, and may substantially simultaneously output the second output image data DAT2 in response to the second load signal TP2. The second digital-to-analog converter 433 may generate the second data voltages based on the second output image data DAT2 and a second polarity control signal included in the third control signal DCONT2. For example, the second digital-to-analog converter 433 may convert the second output image data DAT2 into the second data voltages. The second output buffer 435 may output the second data voltages to the second data lines (e.g., data lines DO21, DE21, DO22, DE22, . . . , DO2*m*, and DE2*m*).

The third switch SW21 may include a first terminal connected to the first electrode of the first capacitor C1 and a second terminal connected to a third portion of the second data lines DO21~DE2*m*. For example, the third portion of the second data lines DO21~DE2*m* may include odd-numbered data lines DO21, DO22, . . . , and DO2*m* of the second data lines DO21~DE2*m*. The fourth switch SW22 may include a first terminal connected to the second electrode of the first capacitor C1 and a second terminal connected to a fourth portion of the second data lines DO21~DE2*m*. For example, the fourth portion of the second data lines DO21~DE2*m* may include even-numbered data lines DE21, DE22, . . . , and DE2*m* of the second data lines DO21~DE2*m*.

The third and fourth switches SW21 and SW22 may selectively connect the first capacitor C1 with the second data lines DO21~DE2*m* in response to the second load signal TP2. For example, when the second load signal TP2 is activated, the first capacitor C1 may be electrically connected to the second data lines DO21~DE2*m*, and the second data driver 430 may perform the second charge sharing during an activation duration of the second load signal TP2.

According to exemplary embodiments of the inventive concept, the number (e.g., n) of the first data lines DO11~DE1*n* may be substantially the same as or different from the number (e.g., m) of the second data lines DO21~DE2*m*.

In the display apparatus 10 according to an exemplary embodiment of the inventive concept, a single capacitor (e.g., the first capacitor C1) used for performing the charge sharing may be shared by at least two data drivers (e.g., the first and second data drivers 410 and 430). Accordingly, by performing the charge sharing, the display apparatus 10 may have relatively low power consumption and temperature. In addition, a boundary between the first region A1 and the second region A2 may not be easily recognized by a user, and thus the display apparatus 10 may have relatively increased display quality.

Figure 3:
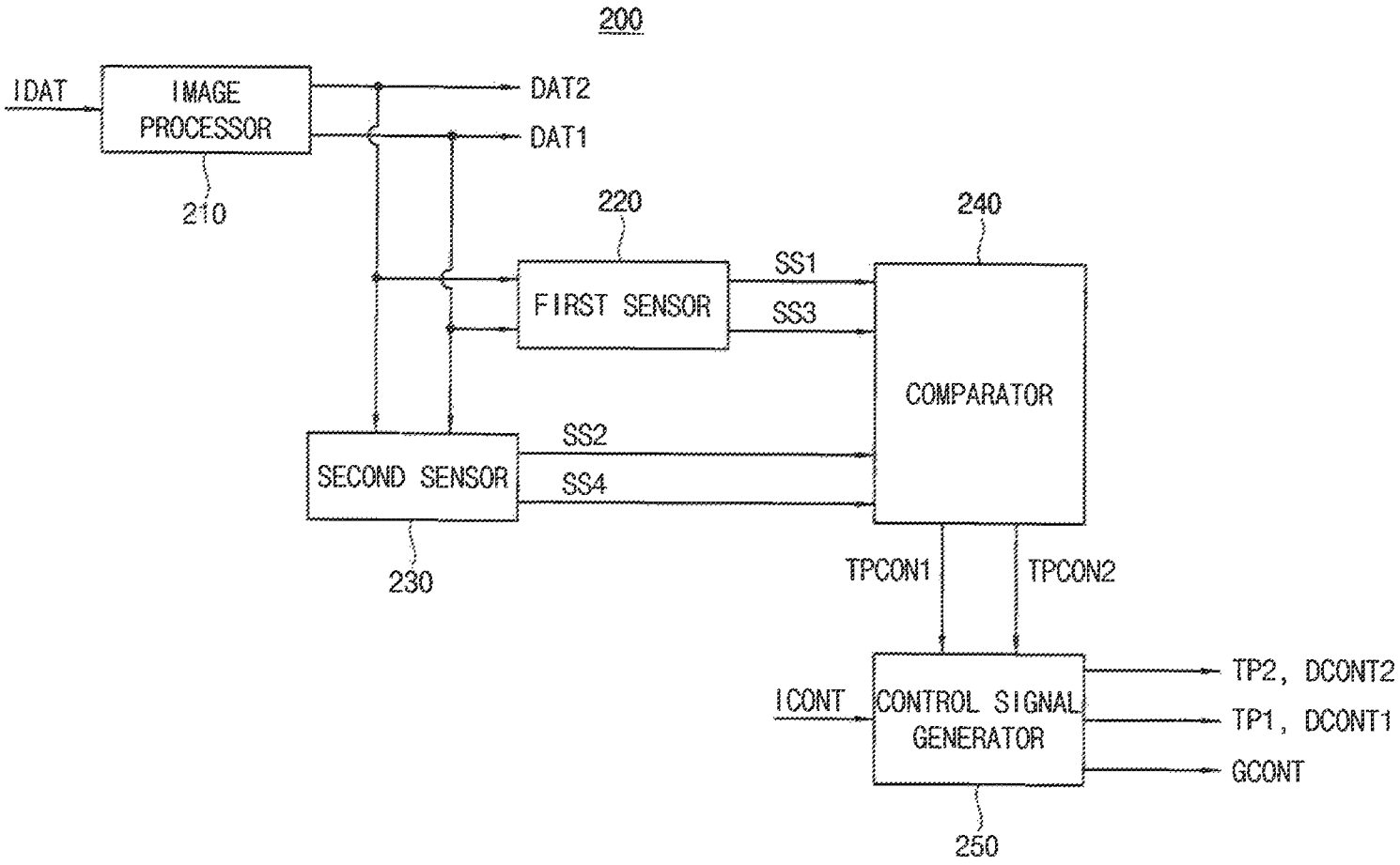
FIG. 3 is a block diagram illustrating a timing controller included in the display apparatus according to an exemplary embodiment of the inventive concept.

FIG. 3 is a block diagram illustrating a timing controller included in the display apparatus according to an exemplary embodiment of the inventive concept.

Referring to FIGS. 1, 2, and 3, the timing controller 200 may include an image processor 210, a first sensor 220, a second sensor 230, a comparator 240, and a control signal generator 250. For convenience of explanation, the timing controller 200 is illustrated in FIG. 3 as being divided into five elements; however, the timing controller 200 may not be physically divided.

The image processor 210 may generate the first output image data DAT1 corresponding to the first region A1 and the second output image data DAT2 corresponding to the second region A2 by performing at least one image processing on the input image data IDAT. For example, the image processor 210 may selectively perform an image quality compensation, a spot compensation, an adaptive color correction (ACC), and/or a dynamic capacitance compensation (DCC) on the input image data IDAT to generate the first and second output image data DAT1 and DAT2.

The first sensor 220 may detect a first sum of first grayscales corresponding to the first portion (e.g., the odd-numbered data lines DO11, DO12, . . . , and DO1*n*) of the first data lines DO11~DE1*n* based on the first output image data DAT1. The first sensor 220 may generate a first value SS1 corresponding to the first sum of the first grayscales. The second sensor 230 may detect a second sum of second grayscales corresponding to the second portion (e.g., the even-numbered data lines DE11, DE12, . . . , and DE1*n*) of the first data lines DO11~DE1*n* based on the first output image data DAT1. The second sensor 230 may generate a second value SS2 corresponding to the second sum of the second grayscales.

In addition, the first sensor 220 may detect a third sum of third grayscales corresponding to the third portion (e.g., the odd-numbered data lines DO21, DO22, . . . , and DO2*m*) of the second data lines DO21~DE2*m* based on the second output image data DAT2. The first sensor 220 may generate a third value SS3 corresponding to the third sum of the third grayscales. The second sensor 230 may detect a fourth sum of fourth grayscales corresponding to the fourth portion (e.g., the even-numbered data lines DE21, DE22, . . . , and DE2*m*) of the second data lines DO21~DE2*m* based on the second output image data DAT2. The second sensor 230 may generate a fourth value SS4 corresponding to the fourth sum of the fourth grayscales.

The comparator 240 may generate a first load control signal TPCON1 by comparing the first sum with the second sum (e.g., based on the first and second values SS1 and SS2), and may generate a second load control signal TPCON2 by comparing the third sum with the fourth sum (e.g., based on the third and fourth values SS3 and SS4).

The control signal generator 250 may generate the first control signal GCONT in response to the input control signal ICONT, may generate the first load signal TP1 and the second control signal DCONT1 in response to the input control signal ICONT and the first load control signal TPCON1, and may generate the second load signal TP2 and the third control signal DCONT2 in response to the input control signal ICONT and the second load control signal TPCON2.

According to exemplary embodiments of the inventive concept, at least one of the activation duration of the first load signal TP1 and the activation duration of the second load signal TP2 may be variable. In other words, a timing of at least one of the first and second charge sharings (e.g., the time required to perform at least one of the first and second charge sharings) may be variable because the first and second charge sharings are performed during the activation durations of the first and second load signals TP1 and TP2, respectively.

According to exemplary embodiments of the inventive concept, the width or, for example, length of the activation duration of the first load signal TP1 may be controlled in response to the first load control signal TPCON1, and the width of the activation duration of the second load signal TP2 may be controlled in response to the second load control signal TPCON2.

According to exemplary embodiments of the inventive concept, at least one of the width of the activation duration of the first load signal TP1 and the width of the activation duration of the second load signal TP2 may be randomly controlled (e.g., may be varied without any predetermined pattern).

Figure 4A:
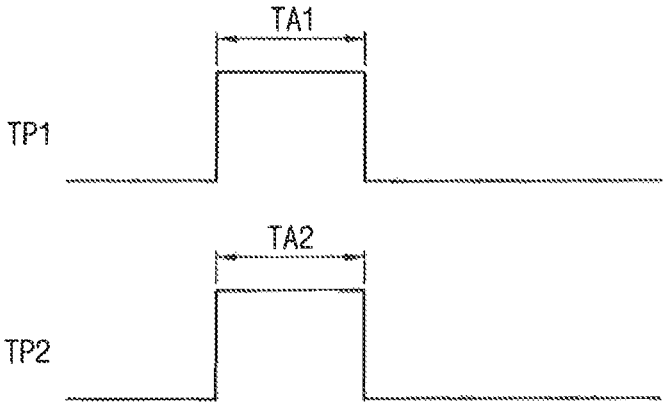
FIGS. 4A, 4B, and 4C are diagrams for describing an operation of the display apparatus according to exemplary embodiments of the inventive concept.
Figure 4B:
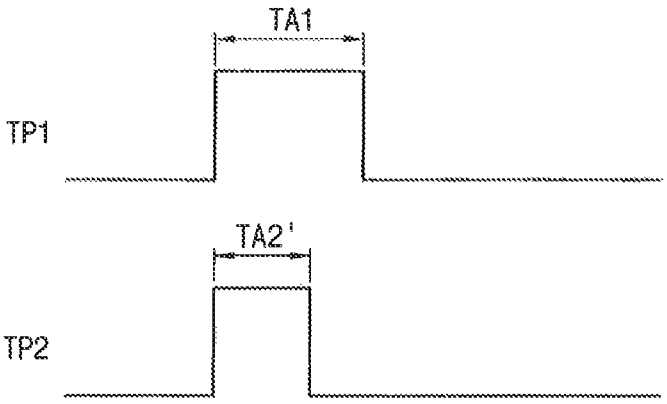
Figure 4C:
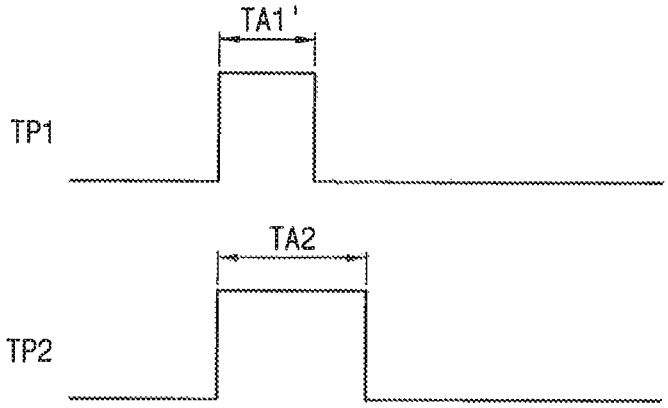

FIGS. 4A, 4B, and 4C are diagrams for describing an operation of the display apparatus according to exemplary embodiments of the inventive concept.

Referring to FIG. 4A, an activation duration TA1 of the first load signal TP1 may be substantially the same as an activation duration TA2 of the second load signal TP2. In other words, each of the width of the activation duration TA1 of the first load signal TP1 and the width of the activation duration TA2 of the second load signal TP2 are not changed, and may be substantially the same as an initial width that is initially set.

Referring to FIG. 4B, the activation duration TA1 of the first load signal TP1 may be different from an activation duration TA2' of the second load signal TP2. For example, the width of the activation duration TA1 of the first load signal TP1 is not changed, and may be the initial width. The width of the activation duration TA2' of the second load signal TP2 may be changed (e.g., decrease) from the initial width, and may be shorter than the initial width.

Referring to FIG. 4C, an activation duration TA1' of the first load signal TP1 may be different from the activation duration TA2 of the second load signal TP2. For example, the width of the activation duration TA1' of the first load signal TP1 may be changed (e.g., decrease) from the initial width, and may be shorter than the initial width. The width of the activation duration TA2 of the second load signal TP2 is not changed, and may be the initial width.

According to exemplary embodiments of the inventive concept, both the width of the activation duration of the first load signal TP1 and the width of the activation duration of the second load signal TP2 may be changed (e.g., decrease) from the initial width, and/or the decreased width of the activation duration (e.g., TA1') of the first load signal TP1 may be different from the decreased width of the activation duration (e.g., TA2') of the second load signal TP2.

In the display apparatus 10 according to an exemplary embodiment of the inventive concept, a single capacitor (e.g., the first capacitor C1) for performing the charge sharing may be shared by at least two data drivers 410 and 430. In addition, the timing of at least one of the charge sharings may be controlled by changing the width of the activation duration of at least one of the load signals TP1 and TP2. Accordingly, the display apparatus 10 may have relatively low power consumption, low temperature, and improved display quality.

Figure 5:
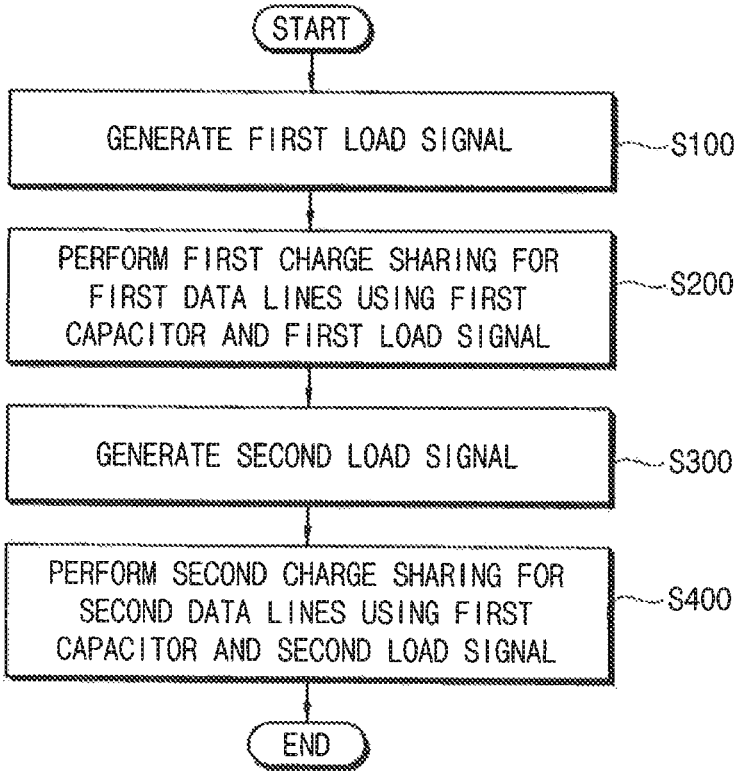
FIG. 5 is a flowchart illustrating a method of operating a display apparatus according to an exemplary embodiment of the inventive concept.

FIG. 5 is a flowchart illustrating a method of operating a display apparatus according to an exemplary embodiment of the inventive concept.

Referring to FIGS. 1 and 5, in the method of operating the display apparatus 10, the first load signal TP1 is generated in response to the input image data IDAT and the input control signal ICONT (operation S100). The first charge sharing for the first data lines, corresponding to the first region A1, is performed using the first capacitor C1 and the first load signal TP1 (operation S200).

The second load signal TP2 is generated in response to the input image data IDAT and the input control signal ICONT (operation S300). The second charge sharing for the second data lines, corresponding to the second region A2, is performed using the first capacitor C1 and the second load signal TP2 (operation S400).

The operations S100 and S300 may be performed by the timing controller 200, the operation S200 may be performed by the first data driver 410, and the operation S400 may be performed by the second data driver 430. As described above with reference to FIG. 1, the first and second data drivers 410 and 430 included in the display apparatus 10 may share the first capacitor C1 for the charge sharing. Each of the first and second charge sharings may be performed using the first capacitor C1.

Although FIG. 5 illustrates that the operations S300 and S400 are performed after the operations S100 and S200, the operations S100 and S300 may be substantially simultaneously or concurrently performed, and then the operations S200 and S400 may be substantially simultaneously or concurrently performed.

Figure 6:
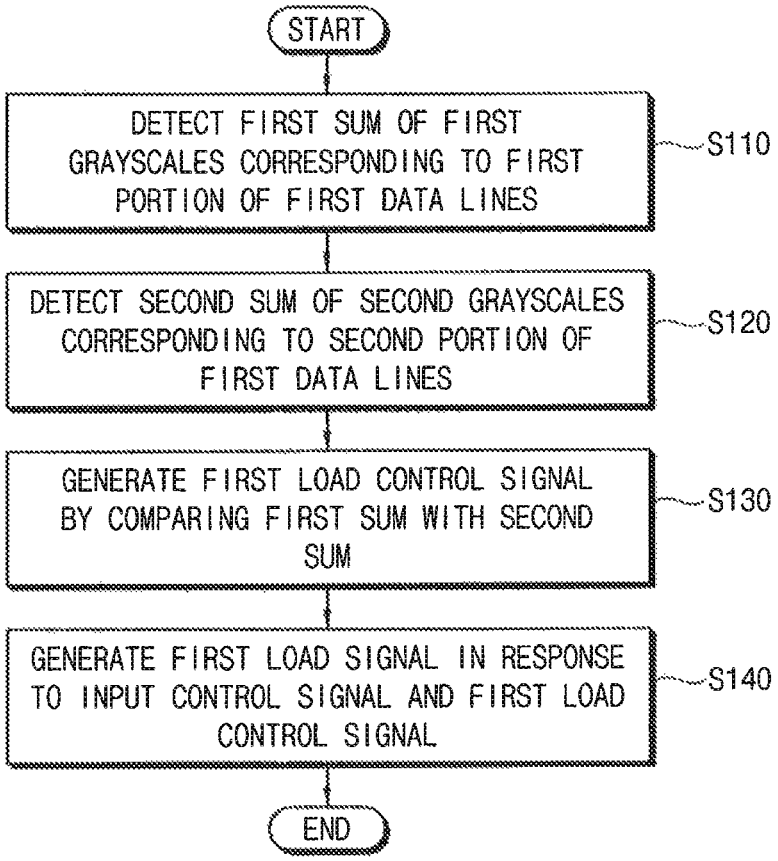
FIG. 6 is a flowchart to illustrate generating a first load signal in FIG. 5 according to an exemplary embodiment of the inventive concept.

FIG. 6 is a flowchart to illustrate generating a first load signal in FIG. 5 according to an exemplary embodiment of the inventive concept.

Referring to FIGS. 1, 2, 3, 5, and 6, in the operation S100, the first sum of the first grayscales, corresponding to the first portion of the first data lines DO11~DE1*n*, may be detected based on the input image data IDAT (e.g., in response to the first output image data DAT1 corresponding to the first region A1) (operation S110). For example, the first portion of the first data lines DO11~DE1*n* may include the odd-numbered data lines DO11, DO12, . . . , and DO1*n* of the first data lines DO11~DE1*n*.

The second sum of the second grayscales, corresponding to the second portion of the first data lines DO11~DE1*n*, may be detected based on the input image data IDAT (e.g., in response to the first output image data DAT1) (operation S120). For example, the second portion of the first data lines DO11~DE1*n* may include the even-numbered data lines DE11, DE12, . . . , and DE1*n* of the first data lines DO11~DE1*n*.

The first load control signal TPCON1 may be generated by comparing the first sum with the second sum (operation S130). For example, it may be determined whether the first sum is substantially the same as or different from the second sum. When the first sum is different from the second sum, it may be further determined whether a difference between the first sum and the second sum is smaller than, equal to, or greater than a reference value.

The first load signal TP1 may be generated in response to the input control signal ICONT and the first load control signal TPCON1 (operation S140). For example, the width of the activation duration of the first load signal TP1 may be controlled in response to the first load control signal TPCON1.

The operation S110 may be performed by the first sensor 220, the operation S120 may be performed by the second sensor 230, the operation S130 may be performed by the comparator 240, and the operation S140 may be performed by the control signal generator 250.

Figure 7:
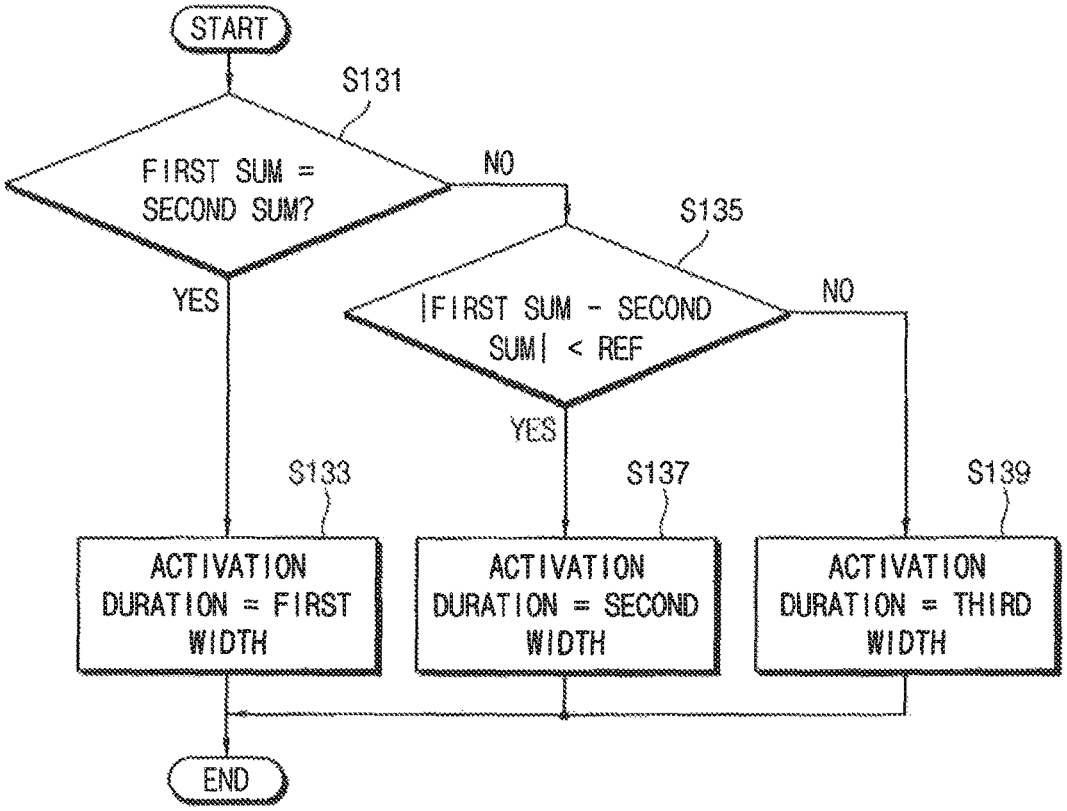
FIG. 7 is a flowchart to illustrate generating a first load control signal in FIG. 5 according to an exemplary embodiment of the inventive concept.

FIG. 7 is a flowchart to illustrate generating a first load control signal in FIG. 5 according to an exemplary embodiment of the inventive concept.

Referring to FIGS. 6 and 7, in the operation S130, it may be determined whether the first sum is substantially the same as the second sum (operation S131).

When the first sum is substantially the same as the second sum (operation S131: YES), the first load control signal TPCON1 may be set to a first level, and the width of the activation duration of the first load signal TP1 may be set to a first width in response to the first load control signal TPCON1 having the first level (operation S133).

When the first sum is different from the second sum (operation S131: NO), the width of the activation duration of the first load signal TP1 may be set to a width shorter than the first width. For example, when the difference between the first sum and the second sum is smaller than a reference value REF (operation S135: YES), the first load control signal TPCON1 may be set to a second level, and the width of the activation duration of the first load signal TP1 may be set to a second width that is shorter than the first width in response to the first load control signal TPCON1 having the second level (operation S137). When the difference between the first sum and the second sum is greater than or equal to the reference value REF (operation S135: NO), the first load control signal TPCON1 may be set to a third level, and the width of the activation duration of the first load signal TP1 may be set to a third width that is shorter than the second width in response to the first load control signal TPCON1 having the third level (operation S139).

In other words, in comparison with a situation where the sum of the grayscales corresponding to the odd-numbered data lines is substantially the same as a the sum of the grayscales corresponding to the even-numbered data lines (and the width of the activation duration of the first load signal TP1 is set to the initial width), the width of the activation duration of the first load signal TP1 may decrease when the sum of the grayscales corresponding to the odd-numbered data lines is different from the sum of the grayscales corresponding to the even-numbered data lines.

Although FIG. 7 illustrates an example where the first sum is compared with the second sum based on one reference value REF when the first sum is different from the second sum, the first sum may be compared with the second sum based on a plurality of reference values. According to an exemplary embodiment of the inventive concept, when the first sum is compared with the second sum based on the plurality of reference values, the width of the activation duration of the first load signal TP1 may decrease as the difference between the first sum and the second sum increases.

Figure 8:
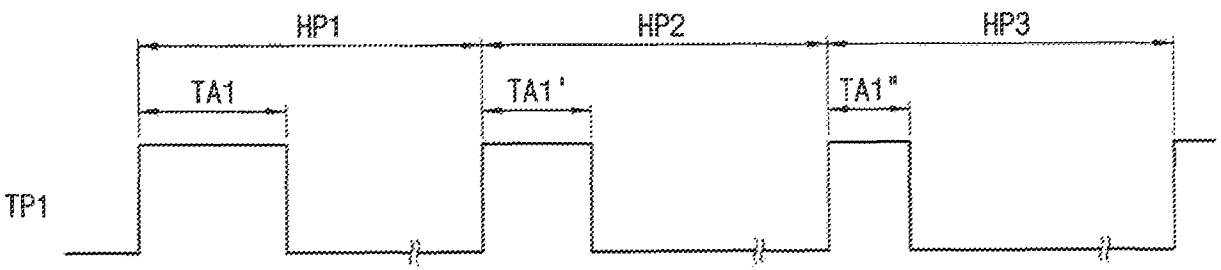
FIG. 8 is a timing diagram for describing the operation of the display apparatus according to an exemplary embodiment of the inventive concept.

FIG. 8 is a timing diagram for describing the operation of the display apparatus according to an exemplary embodiment of the inventive concept.

Referring to FIGS. 7 and 8, in a first horizontal duration HP1, the first sum may be substantially the same as the second sum, and thus the width of the activation duration TA1 of the first load signal TP1 may be set to the first width. In a second horizontal duration HP2, the first sum may be different from the second sum and the difference between the first sum and the second sum may be smaller than the reference value REF, and thus the width of the activation duration TA1' of the first load signal TP1 may be set to the second width. In a third horizontal duration HP3, the first sum may be different from the second sum and the difference between the first sum and the second sum may be greater than or equal to the reference value REF, and thus the width of an activation duration TA1" of the first load signal TP1 may be set to the third width.

As illustrated in FIG. 8, the width of each activation duration in a single load signal (e.g., in the first load signal TP1) may be variable depending on image data corresponding to each horizontal duration (e.g., grayscales of an image displayed during each of the horizontal durations HP1, HP2, HP3).

Figure 9:
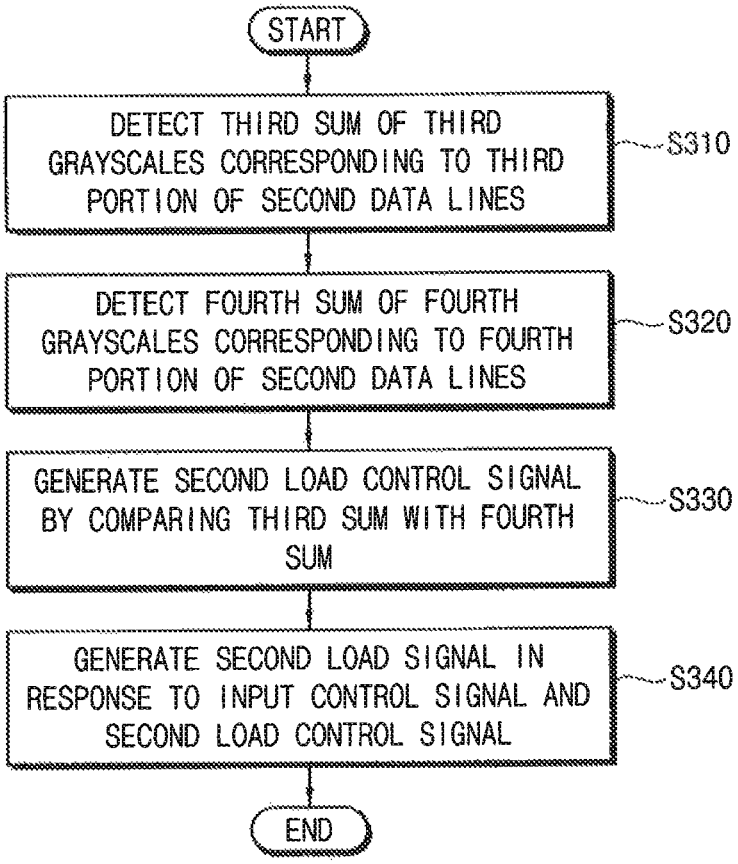
FIG. 9 is a flowchart to illustrate generating a second load signal in FIG. 5 according to an exemplary embodiment of the inventive concept.

FIG. 9 is a flowchart to illustrate generating a second load signal in FIG. 5 according to an exemplary embodiment of the inventive concept.

Referring to FIGS. 1, 2, 3, 5, and 9, in the operation S300, the third sum of the third grayscales corresponding to the third portion of the second data lines DO21~DE2*m* may be detected based on the input image data IDAT (e.g., in response to the second output image data DAT2 corresponding to the second region A2) (operation S310). As described above, the third portion of the second data lines DO21~DE2*m* may include the odd-numbered data lines DO21, DO22, . . . , and DO2*m* of the second data lines DO21~DE2*m*.

The fourth sum of the fourth grayscales corresponding to the fourth portion of the second data lines DO21~DE2*m* may be detected based on the input image data IDAT (e.g., in response to the second output image data DAT2) (operation S320). As described above, the fourth portion of the second data lines DO21~DE2*m* may include the even-numbered data lines DE21, DE22, . . . , and DE2*m* of the second data lines DO21~DE2*m*.

The second load control signal TPCON2 may be generated by comparing the third sum with the fourth sum (operation S330). The second load signal TP2 may be generated in response to the input control signal ICONT and the second load control signal TPCON2 (operation S340).

The operation S330 may be substantially the same as the operation S130 as described with reference to FIGS. 6 and the 7. As described above with reference to FIG. 8, the width of each activation duration in the second load signal TP2 may be variable depending on image data corresponding to each horizontal duration. Additionally, as described above, the width of the activation duration of the second load signal TP2 may be substantially the same or different from the width of the activation duration of the first load signal TP1.

Although exemplary embodiments of the inventive concept have been described above where the widths of the activation durations of the load signals TP1 and TP2 decrease in response to the load control signals TPCON1 and TPCON2, the inventive concept is not limited thereto. For example, the widths of the activation durations of the load signals TP1 and TP2 may increase in response to the load control signals TPCON1 and TPCON2.

Figure 10:
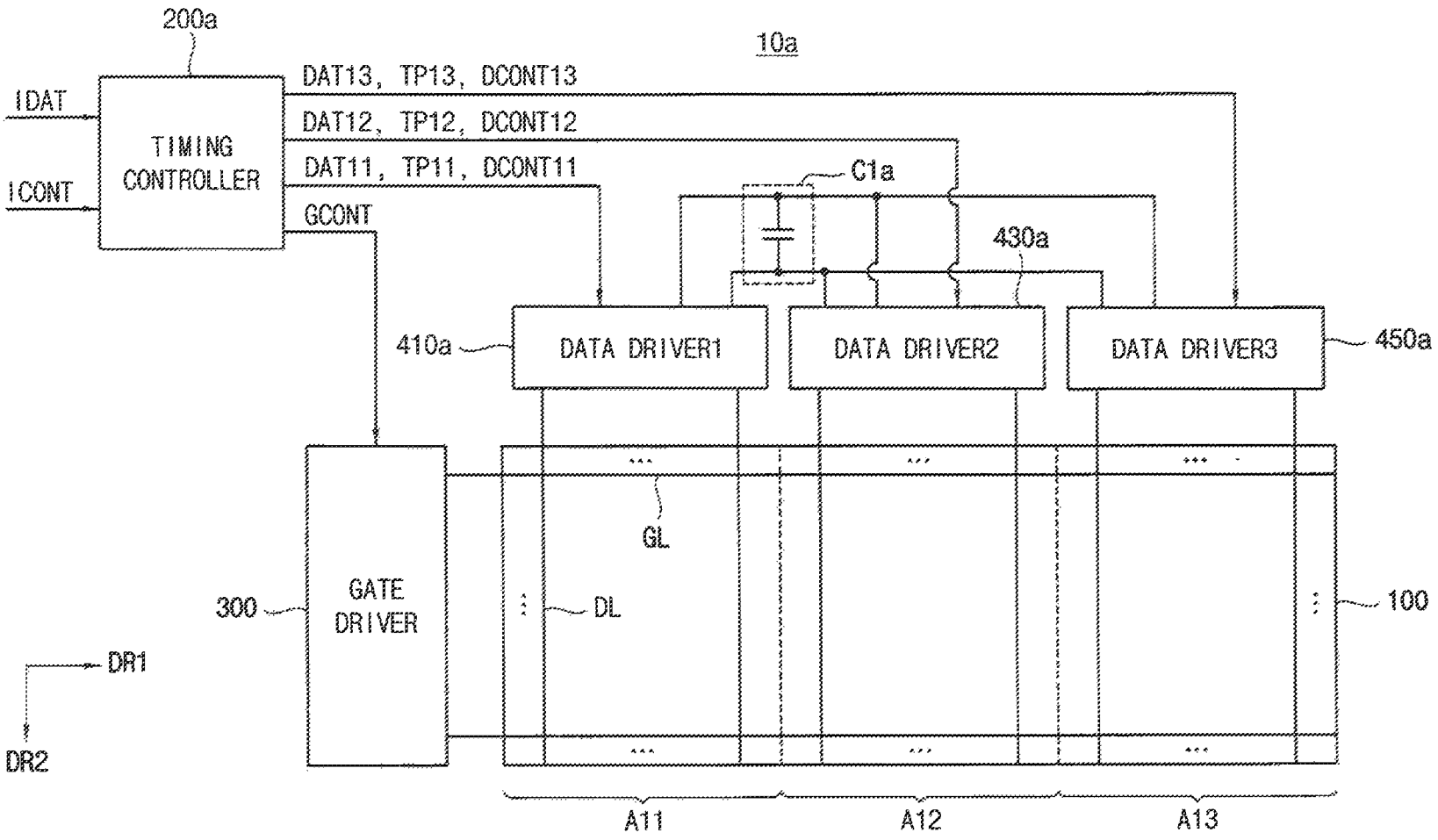
FIGS. 10 and 11 are block diagrams illustrating display apparatuses according to exemplary embodiments of the inventive concept.
Figure 11:
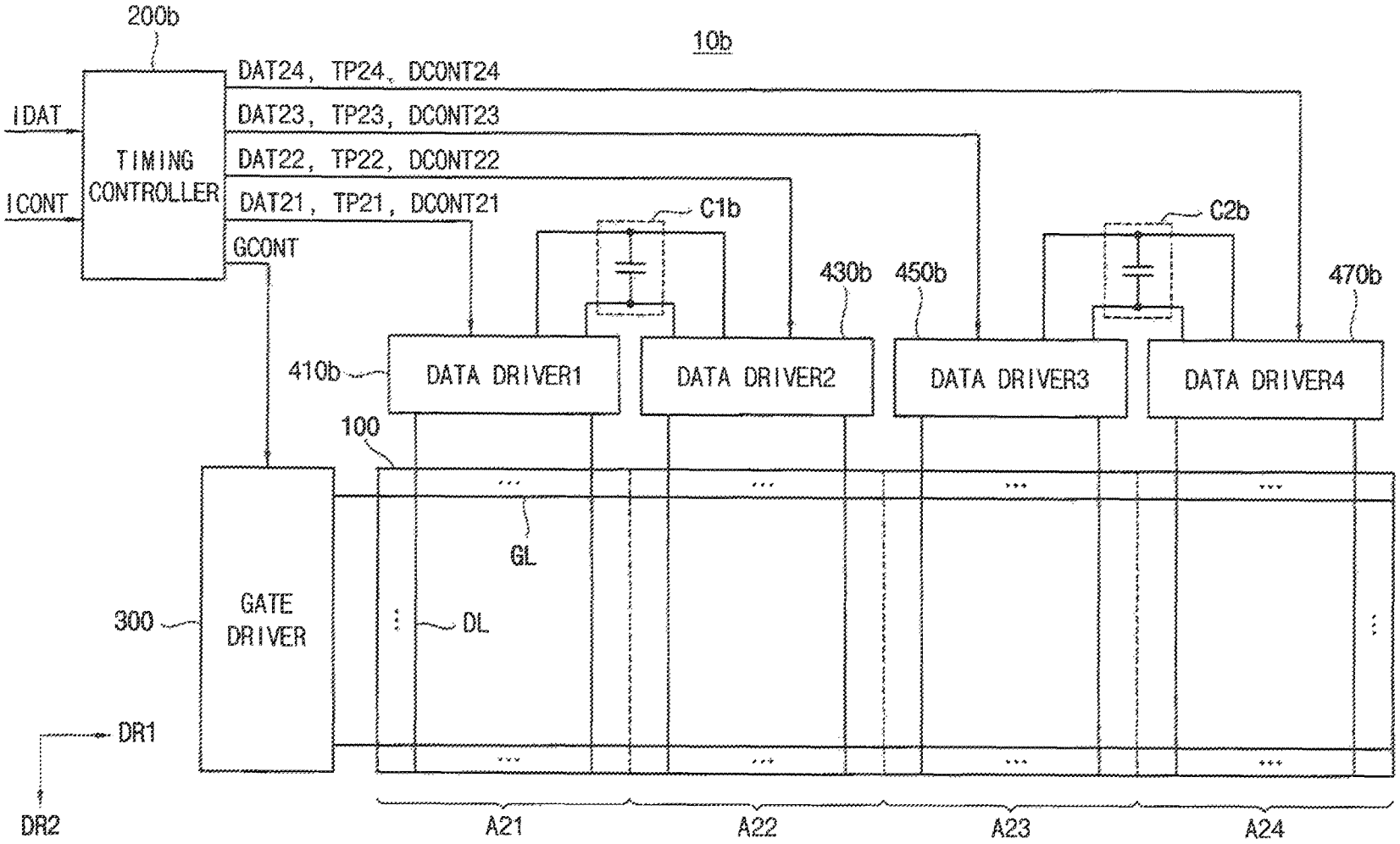

FIGS. 10 and 11 are block diagrams illustrating display apparatuses according to exemplary embodiments of the inventive concept.

Referring to FIG. 10, a display apparatus 10*a* includes the display panel 100, a timing controller 200*a*, the gate driver 300, a first data driver 410*a*, a second data driver 430*a*, a third data driver 450*a*, and a first capacitor C1*a*.

The display apparatus 10*a* of FIG. 10 may be substantially the same as the display apparatus 10 of FIG. 1, except that the display apparatus 10*a* further includes the third data driver 450*a*.

The display panel 100 operates in response to first, second, and third output image data DAT11, DAT12, and DAT13. The display panel 100 may include first, second, and third regions A11, A12, and A13.

The timing controller 200*a* generates the first, second, and third output image data DAT11, DAT12, and DAT13 in response to the input image data IDAT. The first, second, and third output image data DAT11, DAT12, and DAT13 may correspond to the first, second, and third regions A11, A12, and A13, respectively. First, second, and third data lines among the plurality of data lines DL may be arranged in the first, second, and third regions A11, A12, and A13, respectively. The timing controller 200*a* generates the first control signal GCONT for the gate driver 300 in response to the input control signal ICONT. The timing controller 200*a* generates second, third, and fourth control signals DCONT11, DCONT12, and DCONT13 and first, second, and third load signals TP11, TP12, and TP13 for the first, second, and third data drivers 410*a*, 430*a*, and 450*a* in response to the input control signal ICONT.

The gate driver 300 generates the plurality of gate signals for driving the plurality of gate lines GL in response to the first control signal GCONT.

The first, second, and third data drivers 410*a*, 430*a*, and 450*a* generate a plurality of data voltages for driving the data lines DL in response to the first, second, and third load signals TP11, TP12 and TP13, the second, third, and fourth control signals DCONT11, DCONT12, and DCONT13, and the first, second, and third output image data DAT11, DAT12, and DAT13.

The first, second, and third data drivers 410*a*, 430*a*, and 450*a* are connected to the first capacitor C1*a*. The first data driver 410*a* performs a first charge sharing for the first data lines, the second data driver 430*a* performs a second charge sharing for the second data lines, and the third data driver 450*a* performs a third charge sharing for the third data lines. The data drivers 410*a*, 430*a*, and 450*a* may share the first capacitor C1*a* for the charge sharing. The first, second, and third charge sharings may be performed using the first capacitor C1*a* and the first, second, and third load signals TP11, TP12 and TP13. According to exemplary embodiments of the inventive concept, a width of an activation duration of at least one of the load signals TP11, TP12, and TP13 (e.g., a timing of at least one of the first, second, and third charge sharings) may be variable.

Referring to FIG. 11, a display apparatus 10*b* includes the display panel 100, a timing controller 200*b*, the gate driver 300, a first data driver 410*b*, a second data driver 430*b*, a third data driver 450*b*, a fourth data driver 470*b*, a first capacitor C1*b*, and a second capacitor C2*b*.

The display apparatus 10*b* of FIG. 11 may be substantially the same as the display apparatus 10 of FIG. 1, except that the display apparatus 10*b* further includes the third and fourth data drivers 450*b* and 470*b* and the second capacitor C2*b*.

The display panel 100 operates in response to first, second, third, and fourth output image data DAT21, DAT22, DAT23, and DAT24. The display panel 100 may include first, second, third, and fourth regions A21, A22, A23, and A24.

The timing controller 200*b* generates the first, second, third, and fourth output image data DAT21, DAT22, DAT23, and DAT24 in response to the input image data IDAT. The first, second, third, and fourth output image data DAT21, DAT22, DAT23, and DAT24 may correspond to the first, second, third, and fourth regions A21, A22, A23, and A24, respectively. First, second, third, and fourth data lines among the plurality of data lines DL may be arranged in the first, second, third, and fourth regions A21, A22, A23, and A24, respectively. The timing controller 200*b* generates the first control signal GCONT for the gate driver 300 in response to the input control signal ICONT. The timing controller 200*b* generates second, third, fourth, and fifth control signals DCONT21, DCONT22, DCONT23, and DCONT24 and first, second, third, and fourth load signals TP21, TP22, TP23, and TP24 for the first, second, third, and fourth data drivers 410*b*, 430*b*, 450*b*, and 470*b* in response to the input control signal ICONT.

The gate driver 300 generates the plurality of gate signals for driving the plurality of gate lines GL in response to the first control signal GCONT.

The first, second, third, and fourth data drivers 410*b*, 430*b*, 450*b*, and 470*b* generate a plurality of data voltages for driving the data lines DL in response to the first, second, third, and fourth load signals TP21, TP22, TP23, and TP24, the second, third, fourth, and fifth control signals DCONT21, DCONT22, DCONT23, and DCONT24, and the first, second, third, and fourth output image data DAT21, DAT22, DAT23, and DAT24.

The first and second data drivers 410*b* and 430*b* are connected to the first capacitor C1*b*, and the third and fourth data drivers 450*b* and 470*b* are connected to the second capacitor C2*b*. The first data driver 410*b* performs a first charge sharing for the first data lines, the second data driver 430*b* performs a second charge sharing for the second data lines, the third data driver 450*b* performs a third charge sharing for the third data lines, and the fourth data driver 470*b* performs a fourth charge sharing for the fourth data lines. The first and second data drivers 410*b* and 430*b* may share the first capacitor C1*b* for the charge sharing, and the third and fourth data drivers 450*b* and 470*b* may share the second capacitor C2*b* for the charge sharing. The first and second charge sharings may be performed using the first capacitor C1*b* and the first and second load signals TP21 and TP22. The third and fourth charge sharings may be performed using the second capacitor C2*b* and the third and fourth load signals TP23 and TP24. According to exemplary embodiments of the inventive concept, a width of an activation duration of at least one of the load signals TP21, TP22, TP23, and TP24 (e.g., a timing of at least one of the first, second, third, and fourth charge sharings) may be variable.

Although exemplary embodiments of the inventive concept are described above where the display apparatus includes a specific number of data drivers and a specific number of capacitors, the inventive concept is not limited thereto and the display apparatus may include any number of data drivers and any number of capacitors. For example, when a display apparatus according to an exemplary embodiment of the inventive concept includes six data drivers, the display apparatus may include one capacitor that is shared by six data drivers, may include two capacitors each of which is shared by three data drivers, or may include three capacitors each of which is shared by two data drivers.

The above described exemplary embodiments may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc.

As described above, in the display apparatus according to exemplary embodiments of the inventive concept, a single capacitor for performing the charge sharing may be shared by a plurality of data drivers, and timing of the charge sharing may be controlled by changing the widths of activation durations of load signals. Accordingly, the display apparatus may have relatively low power consumption and temperature by performing the charge sharing. In addition, boundaries in the display panel caused by the plurality of data drivers may not be easily recognized by a user, and thus, the display apparatus may have relatively increased display quality.

While the inventive concept has been shown and described with reference to exemplary embodiments thereof, it will be understood by those of ordinary skill in the art that various changes in form and details may be made thereto without departing from the spirit and scope of the inventive concept as defined by the following claims.

What is claimed is:

1. A display apparatus comprising:

a display panel connected to a plurality of data lines;

a first data driver connected to first data lines among the plurality of data lines, wherein the first data driver is configured to perform a first charge sharing for the first data lines by connecting the first data lines to one another;

a second data driver connected to second data lines among the plurality of data lines, wherein the second data driver is configured to perform a second charge sharing for the second data lines by connecting the second data lines to one another;

a first capacitor connected to the first data driver and the second data driver; and a timing controller configured to generate first output image data corresponding to the first data lines and second output image data corresponding to the second data lines in response to input image data, configured to generate a first load signal and a second load signal in response to an input control signal, configured to provide the first output image data and the first load signal to the first data driver, and configured to provide the second output image data and the second load signal to the second data driver, wherein each of the first and second charge sharings is performed using the first capacitor.

2. The display apparatus of claim 1, wherein the first data driver performs the first charge sharing during a first activation duration of the first load signal, wherein the second data driver performs the second charge sharing during a second activation duration of the second load signal, and wherein the first activation duration of the first load signal or the second activation duration of the second load signal is variable.

3. The display apparatus of claim 2, wherein the first activation duration is substantially the same as the second activation duration.

4. The display apparatus of claim 2, wherein the first activation duration is different from the second activation duration.

5. The display apparatus of claim 1, wherein the timing controller comprises:

a first sensor configured to detect a first sum of first grayscales corresponding to a first portion of the first data lines in response to the first output image data;

a second sensor configured to detect a second sum of second grayscales corresponding to a second portion of the first data lines in response to the first output image data;

a comparator configured to generate a first load control signal by comparing the first sum with the second sum; and a control signal generator configured to generate the first load signal in response to the input control signal and the first load control signal, wherein a first activation duration of the first load signal is controlled in response to the first load control signal, and the first data driver performs the first charge sharing during the first activation duration of the first load signal.

6. The display apparatus of claim 5, wherein when the first sum is substantially the same as the second sum, the first activation duration has a first length, and wherein when the first sum is different from the second sum, the first activation duration has a length that is shorter than the first length.

7. The display apparatus of claim 6, wherein when a difference between the first sum and the second sum is smaller than a reference value, the first activation duration has a second length that is shorter than the first length, and wherein when the difference between the first sum and the second sum is greater than or equal to the reference value, the first activation duration has a third length that is shorter than the second length.

8. The display apparatus of claim 5, wherein the first portion of the first data lines includes odd-numbered data lines of the first data lines, and wherein the second portion of the first data lines includes even-numbered data lines of the first data lines.

9. The display apparatus of claim 5, wherein the first sensor is further configured to detect a third sum of third grayscales corresponding to a third portion of the second data lines in response to the second output image data, wherein the second sensor is further configured to detect a fourth sum of fourth grayscales corresponding to a fourth portion of the second data lines in response to the second output image data, wherein the comparator is further configured to generate a second load control signal by comparing the third sum with the fourth sum, wherein the control signal generator is further configured to generate the second load signal in response to the input control signal and the second load control signal, wherein a second activation duration of the second load signal is controlled in response to the second load control signal, and the second data driver performs the second charge sharing during the second activation duration of the second load signal.

10. The display apparatus of claim 5, wherein the timing controller further comprises:

an image processor configured to generate the first output image data and the second output image data in response to the input image data.

11. The display apparatus of claim 1, wherein the first data driver comprises:

a first switch including a first terminal connected to a first electrode of the first capacitor and a second terminal connected to odd-numbered data lines of the first data lines; and a second switch including a first terminal connected to a second electrode of the first capacitor and a second terminal connected to even-numbered data lines of the first data lines.

12. The display apparatus of claim 1, further comprising:

a third data driver connected to the first capacitor and third data lines among the plurality of data lines, wherein the third data driver is configured to perform a third charge sharing for the third data lines, and wherein the first, second, and third data drivers share the first capacitor, and the third charge sharing is performed using the first capacitor.

13. The display apparatus of claim 1, further comprising:

a third data driver connected to third data lines among the plurality of data lines, wherein the third data driver is configured to perform a third charge sharing for the third data lines;

a fourth data driver connected to fourth data lines among the plurality of data lines, wherein the fourth data driver is configured to perform a fourth charge sharing for the fourth data lines; and a second capacitor connected to the third data driver and the fourth data driver, wherein each of the third and fourth charge sharings is performed using the second capacitor.

14. A method of operating a display apparatus, the display apparatus comprising a first data driver and a second data driver, the method comprising:

generating a first load signal in response to input image data and an input control signal;

performing, with the first data driver, a first charge sharing for first data lines, among a plurality of data lines, using a first capacitor and the first load signal;

generating a second load signal in response to the input image data and the input control signal; and performing, with the second data driver, a second charge sharing for second data lines, among the plurality of data lines, using the first capacitor and the second load signal, wherein the first and second data drivers share the first capacitor.

15. The method of claim 14, wherein generating the first load signal comprises:

detecting a first sum of first grayscales corresponding to a first portion of the first data lines in response to the input image data;

detecting a second sum of second grayscales corresponding to a second portion of the first data lines in response to the input image data;

generating a first load control signal by comparing the first sum with the second sum; and generating the first load signal in response to the input control signal and the first load control signal, wherein a first activation duration of the first load signal is controlled in response to the first load control signal, and the first data driver performs the first charge sharing during the first activation duration of the first load signal.

16. The method of claim 15, wherein when the first sum is substantially the same as the second sum, the first activation duration has a first width, and wherein when the first sum is different from the second sum, the first activation duration has a width that is shorter than the first width.

17. The method of claim 16, wherein when a difference between the first sum and the second sum is smaller than a reference value, the first activation duration has a second width that is shorter than the first width, and wherein when the difference between the first sum and the second sum is greater than or equal to the reference value, the first activation duration has a third width that is shorter than the second width.

18. The method of claim 15, wherein the first portion of the first data lines includes odd-numbered data lines of the first data lines, and wherein the second portion of the first data lines includes even-numbered data lines of the first data lines.

19. A display apparatus, comprising:

a display panel connected to a plurality of data lines;

a timing controller configured to generate a first load signal and a second load signal;

a first data driver comprising a first switch and a second switch, wherein the first data driver is connected to first data lines among the plurality of data lines;

a second data driver comprising a third switch and a fourth switch, wherein the second data driver is connected to second data lines among the plurality of data lines; and a first capacitor connected to the first data driver and the second data driver, wherein the first switch connects a first portion of the first data lines to a first electrode of the first capacitor in response to the first load signal, the second switch connects a second portion of the first data lines to a second electrode of the first capacitor in response to the first load signal, the third switch connects a third portion of the second data lines to the first electrode of the first capacitor in response to the second load signal, and the fourth switch connects a fourth portion of the second data lines to the second electrode of the first capacitor in response to the second load signal.

* * * * *